US007380678B1

(12) United States Patent
Johnsen

(10) Patent No.: US 7,380,678 B1
(45) Date of Patent: Jun. 3, 2008

(54) LID FOR CLOSING A CONTAINER

(75) Inventor: Lars Johnsen, Tarm (DK)

(73) Assignee: Lid System A/S, Tarm (DK)

( * ) Notice: Subject to any disclaimer, the term of this patent is extended or adjusted under 35 U.S.C. 154(b) by 0 days.

(21) Appl. No.: 09/936,820

(22) PCT Filed: Mar. 17, 2000

(86) PCT No.: PCT/DK00/00121

§ 371 (c)(1),
(2), (4) Date: Oct. 23, 2001

(87) PCT Pub. No.: WO00/56622

PCT Pub. Date: Sep. 28, 2000

(30) Foreign Application Priority Data

Mar. 18, 1999 (DK) ..... 1999 00393
Nov. 19, 1999 (DK) ..... 1999 01665

(51) Int. Cl.
*B65D 41/62* (2006.01)
*B65D 51/16* (2006.01)
*B65D 53/04* (2006.01)
*B65D 51/18* (2006.01)

(52) U.S. Cl. ..... 215/277; 215/262; 215/341; 215/347; 215/349; 215/350

(58) Field of Classification Search ..... 215/277, 215/347, 349, 350, 232, 262, 341
See application file for complete search history.

(56) References Cited

U.S. PATENT DOCUMENTS 3,006,493 A * 10/1961 Acton ..... 215/337
4,109,815 A * 8/1978 Collins, III ..... 215/232
4,452,842 A * 6/1984 Borges et al. ..... 428/195.1
4,473,163 A 9/1984 Geiger
4,723,678 A * 2/1988 Kollen et al. ..... 215/347
4,748,735 A * 6/1988 Hayes ..... 29/453
4,789,074 A * 12/1988 Han ..... 215/347

(Continued)

FOREIGN PATENT DOCUMENTS

GB 2122178 1/1984

*Primary Examiner*—Anthony D. Stashick
*Assistant Examiner*—Niki M. Eloshway
(74) *Attorney, Agent, or Firm*—Dykema Gossett PLLC

(57) ABSTRACT

The invention relates to a lid (1) and a method of opening the lid which is used for closing a container (15) having means on the inner side of screwing on to the neck (2) of a container. Internally, the lid has an inner lid (5) which is secured in the lid (1) by at least one securing means. The object of the invention is to provide a lid which is easy to open without using a great force or by using a tool, and which may simultaneously be disposed of without significant environmental impact. This is achieved by a lid (1) whose collar (3) has at least one projection (13) which points radially toward the centre and which extends from the inner side of the collar (3), wherein, during unscrewing of the lid (1), the projection (13) presses the edge of the inner lid (5) at least at one point out of contact with the upper edge of the package neck. This ensures venting of the volume of the container with a relatively weak torque. By just affecting the inner lid (5) at a single point in an upward direction, the force required for creating venting will be greatly reduced.

13 Claims, 3 Drawing Sheets

U.S. PATENT DOCUMENTS 4,991,731 A * 2/1991 Osip et al. ..... 215/232
5,730,306 A * 3/1998 Costa et al. ..... 215/261
5,839,592 A * 11/1998 Hayes ..... 215/230
5,860,544 A * 1/1999 Brucker ..... 215/232
5,884,788 A * 3/1999 Wilde ..... 215/230
5,915,577 A * 6/1999 Levine ..... 215/232
6,581,793 B1 * 6/2003 Racine et al. ..... 215/350

* cited by examiner

LID FOR CLOSING A CONTAINER

The invention relates to a lid for closing a container which has a neck with means for securing the lid, wherein an outer lid consists of a top part and a cylindrical collar which has means on the inner side for securing the lid on the neck of the container, and wherein an inner lid is provided between the outer lid and the edge of the container neck.

Lids of this type are known inter alia from EP-B-411385. This document describes a screw lid which ensures tight sealing of a container with a negative pressure. To open the lid, however, a great force is required to rotate the lid sufficiently for achieving pressure equalization in the package container. Only after pressure equalization can the lid be removed. To facilitate opening of screw lids, many kitchens have tools for opening lids.

GB 2 122 178 A discloses a plastics lid equipped with a plurality of projections which upon unscrewing engage an inner lid which is thereby lifted out of contact with a container. A large number of projections is provided, or there is one annular projection which causes an inner lid to be lifted free. The external plastics lid itself is open in the centre, so that just the inner lid provides for the actual covering of the internal volume of the container.

It is unfortunate that the outer lid is open in the centre, if the container is to have a considerable negative pressure. Hereby, the pressure difference will pre-vail on the entire surface of the inner lid. Also, the inner lid may easily be broken, if it is subjected to a mechanical impact, and there will be direct access from the external atmosphere to the interior of the container. During opening of the lid, the large number of projections will simultaneously try to lift the inner lid on its entire circumference. Hereby, a relatively great force must be applied to lift the inner lid free. Particularly if the lid has a large area, the method will be directly unfortunate.

The object of the invention is to provide a lid which is easy to open without the use of a great force or by using a tool, and which may be disposed of without any significant environmental impact.

This may be achieved by a lid like the one described in the opening paragraph, if the collar of the outer lid has at least one projection which points radially toward the centre and which extends from the inner side of the collar, said projection, during removal of the lid, exerting an upwardly directed pressure against the edge of the inner lid at least at one point which causes the inner lid to be lifted out of contact with the upper edge of the package neck.

Venting of the volume of the container can be achieved hereby by affecting the lid with a relatively weak force. By concentrating the force at a single point and affecting the inner lid in an upward direction, the force required to create venting of the inner volume will be greatly reduced. If the number of projections is increased considerably, the force to be used will be relatively great. By just lifting the inner lid at a single point, it is ensured that the smallest conceivable force is sufficient to open the lid. Thus, most users will be able to open the package without using a tool.

The diameter of the inner lid may advantageously be larger than the external diameter of the package neck, but simultaneously smaller than the internal diameter of the outer lid, said projection of the collar extending radially toward the centre until the external diameter of the package neck. Hereby, the projection of the outer lid can press the inner lid upwards at one point and thereby vent the volume of the container.

The inner layer may be made of a multi-layered sheet, wherein the upper layer of the inner lid may have a relatively greater friction with the lid than the lower layer of the inner lid which has a relatively lower friction with the edge of the container collar. A combination of several material properties may be achieved hereby. It may also be ensured that the inner lid follows the rotation of the lid so that the rotary movement takes place between package container and inner lid. The lid may be rotated with a low torque because the container is typically made of glass with a smooth surface.

As an alternative, the inner lid may be made of a multi-layered sheet, wherein the upper layer of the inner lid has a relatively lower friction with the lid than the lower layer of the inner lid which has a relatively higher friction with the edge of the container collar. It is ensured hereby that the outer lid rotates relatively to the inner lid until the inner lid is lifted by the projection of the lid. Then, the inner lid can follow the rotation of the outer lid.

The inner lid may consist of a metal layer which is surrounded by plastics. Hereby, the inner lid may achieve rigidity, which may be an advantage when the projection of the outer lid begins to press the inner lid pointwise out of contact with the edge of the package container.

The collar of the lid may be provided with an inwardly facing annular ring, which extends obliquely relatively to the inner lid. It may be ensured hereby during opening that the ring will pointwise press the edge of the inner lid upwards, thereby forming a duct to the container volume.

The inner lid may have a hole for pressure equalization between the volume of the container and a volume between outer lid and inner lid. A vacuum indicator on the outer side of the lid may be activated hereby.

A seal sealing against the outer lid may be provided around an opening in the inner lid, said outer lid having a subarea above the opening of the inner lid which is deflected by a pressure difference. Hereby a vacuum indicator on the outer side of the lid may be activated with indication for maintenance of vacuum in the container, even though a volume between outer lid and inner lid communicates with the surroundings.

The centre of the inner lid may be secured to the outer lid with a rotatable securing means, wherein a container vacuum through the inner lid pulls the centre of the outer lid downwards, thereby deflecting a subarea of the outer lid. Vacuum may hereby be indicated on the outer side of the lid.

Advantageously, the inner lid may be made of a halogen-free material. Disposal of the lid may hereby take place without significant environmental impact.

The inner lid may be made of a metal which may be deformed and absorb irregularities on the surface of the package neck. Also, metal will provide a good seal against leakage of air.

The inner lid may consist of a first layer for sealing against the edge of the container, wherein the first layer consists of a soft thermoplastic elastomer, and wherein the inner lid also consists of a second layer having gas barrier properties. Hereby, the inner lid can absorb irregularities from the container edge, while the inner lid prevents penetration of e.g. oxygen.

The inner lid may also consist of a third layer consisting of thermoplastics which covers the second layer, said third layer making contact with the outer lid. Hereby, great rigidity for the inner lid may be achieved, and an underlying metal layer may be thin.

The second layer may advantageously consist of aluminium. Aluminium can form a good gas barrier even with a very thin layer.

The first layer may consist of low density polyolefins. Hereby, a good seal with an uneven container edge can be formed.

The first layer may instead consist of low density polyethylenes. Hereby a good seal with an uneven container edge can be formed.

The third layer may likewise consist of polyolefins, polyethylene, polypropylene or ethylene vinyl acetate. Hereby a good seal with the outer lid can be obtained.

The third layer may instead consist of polyester. Hereby, the inner lid can resist higher temperatures that may occur during sterilization of a container after the lid has been mounted.

The invention also relates to a method of opening a lid which is used for closing a container having a neck with means for securing the lid, which consists of a top part and a cylindrical collar having means on the inner side for securing on the neck of a container, said lid internally having an inner lid, wherein opening of the container takes place by removing the lid, thereby exerting a pointwise upwardly directed pressure on the edge of the inner lid, thereby creating an opening to the volume of the container which is vented.

The invention will be explained below with reference to drawings, in which:

FIG. 1 shows an embodiment, shown in FIG. 2, of a lid according to the invention seen in section along the line I-I, FIG. 2 shows an embodiment of a lid according to the invention seen from the bottom of the lid, FIG. 3 shows a second embodiment of a lid according to the invention shown in section, FIG. 4 shows a third embodiment, shown in FIG. 5, of a lid according to the invention shown in section along the line IV-IV, and FIG. 5 shows a third embodiment of a lid according to the invention seen from the bottom.

FIG. 1 shows a lid 1 in relation to a package neck 15, 2, which package neck 15, 2 comprises outer convolutions/threads 12. The lid 1 is shown in section and comprises a cylindrical collar 3 having an annular bead/screw part 4 which is formed on the inner face of the collar and projects radially from it, and which preferably extends from the lower termination face of the collar 3. The opposite end of the collar 3 ends in a top part 6 which is essentially formed as a plane face in integral connection with the collar 3. In the lid, a loose, circular plate (planar) called the inner lid 5 is positioned, whose diameter essentially corresponds to the diameter of the collar 3 and is larger than the external diameter of the package neck. A projection 13 in the form of a cylindrical or box-shaped pin extends from the inner face of the collar 3, and this projection 13 has an extent such that it extends into the peripheral part of the inner lid 5, i.e., from the edge and a small distance from it, preferably 1-3 mm, where the free end 7 of the projection ends. The projection 13 may be shaped as a cylinder or as a decidedly plane face, the essential point being that it has a small contact area so that when the lid is removed and the venting function is released, the force must be distributed over as small an area as possible, thereby achieving partly a great moment, partly a great pressure at the place concerned. Additional projections 14 may be arranged in the lid, and these additional projections 14 are all positioned at a greater distance from the inner lid 5 than the active projections 13, the purpose of the additional projections 14 exclusively being to ensure that the inner lid does not drop out. The additional projections 14 are essentially shaped like the projections 13.

Figure 1:
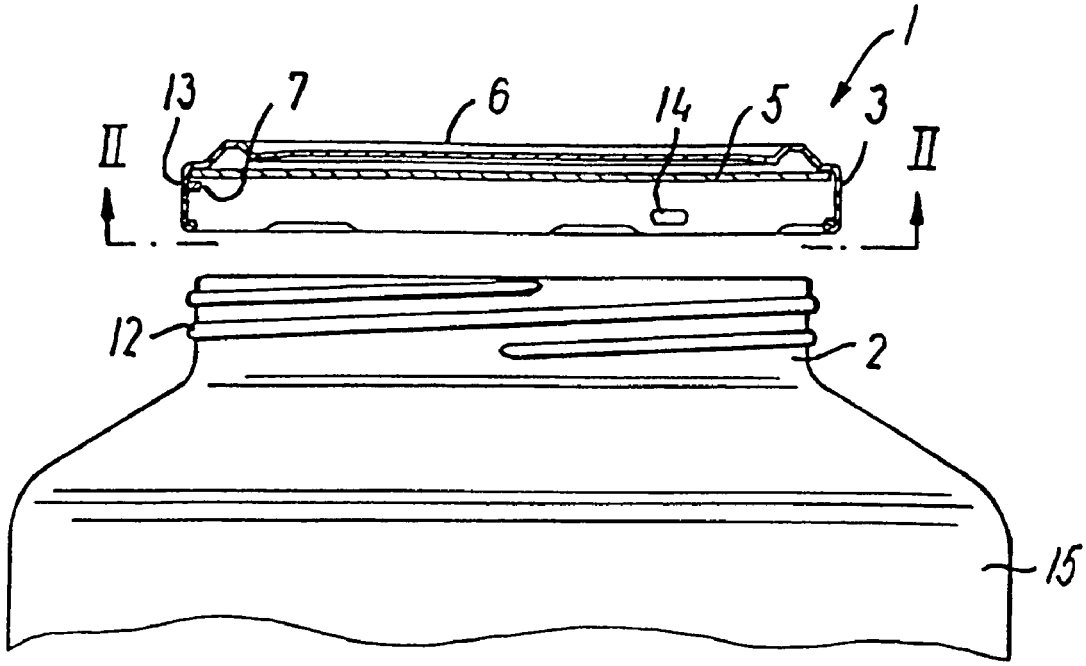
Figure 2:
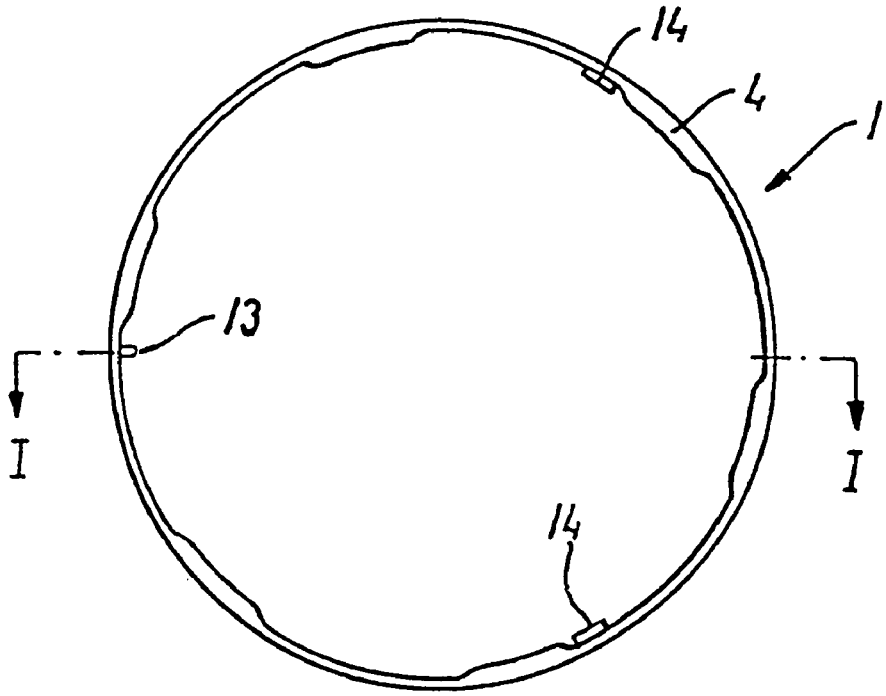
FIG. 2 shows the positions of the projections (13, 14) seen from the bottom, which are staggered 1200.
Figure 3:
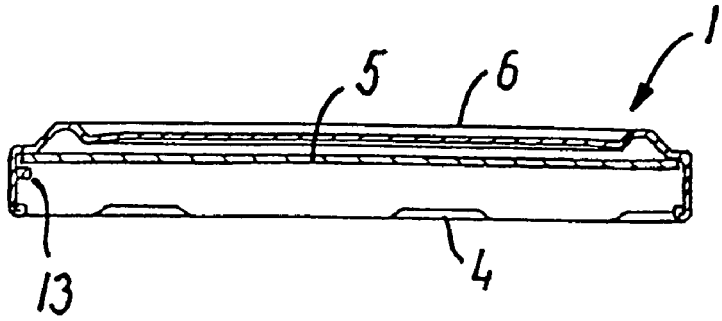
FIG. 3 shows the lid 1 indicated in FIG. 1, but where these additional projections 14 are not part of the structure.
Figure 4:
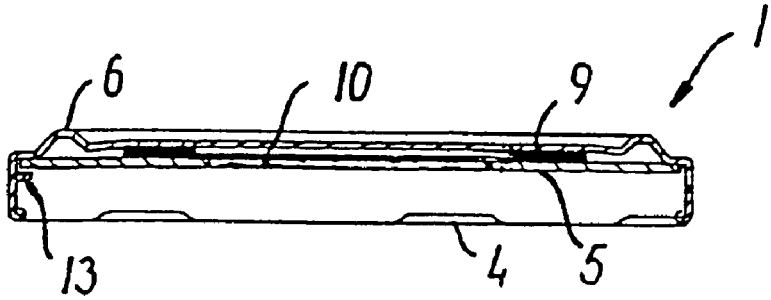

FIG. 4 shows a third embodiment of the invention, where the position of the projection 13 is the same as stated before, but where the inner lid 5 itself may be formed with a circular hole 10 whose centre coincides with that of the inner lid 5. In order to still ensure a sealingly closed lid 1, a sealing ring 9 is provided between the upper side of the inner lid 5 and the underside of the top part 6, said sealing ring 9 being positioned radially with respect to the hole so as to achieve a tight connection between the inner lid 5 and the top part 6.

Figure 5:
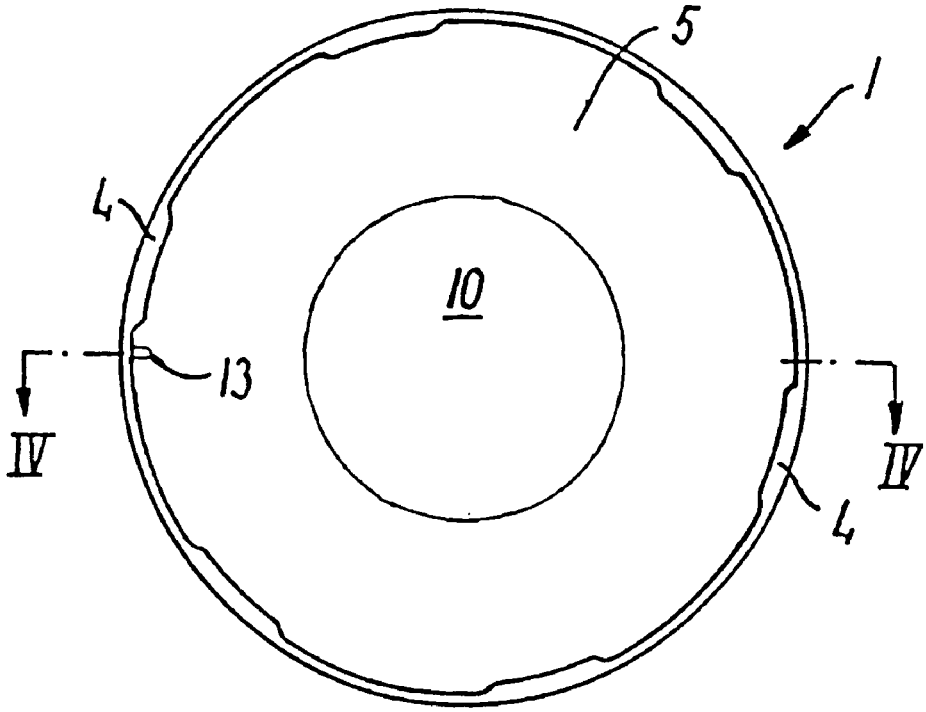

FIG. 5 shows an inner lid 5 arranged in an outer lid, said inner lid having an opening 10.

Figure 6:
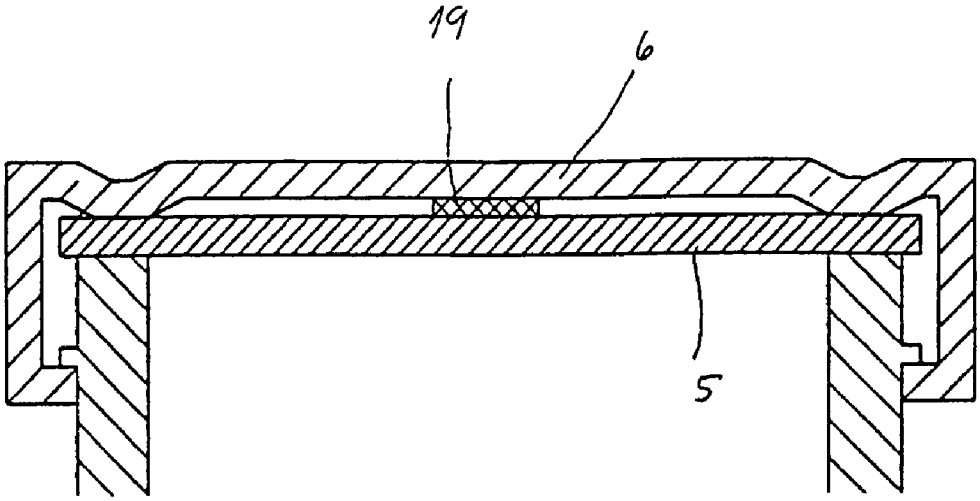

FIG. 6 shows an alternative embodiment of the invention, where the inner lid 5 is secured to the top part 6 of the outer lid with a rotatable securing means 19 which may be made of flexible plastics. Hereby a vacuum in a container can exert a downward pull in the outer lid, whereby a subarea of the outer lid is bent down.

The inner lid and the outer lid may be made of metal, plastics or cardboard which is coated, where the projections form an integral part of the lid or are subsequently mounted in the lid as pins by riveting or screwing after the inner lid has been arranged.

The inner lid may advantageously have a rigidity which, as soon as the projection begins to move the edge of the inner lid upwards, causes an open channel to be formed which vents the container. The necessary rigidity of the inner lid may be achieved either in that, as mentioned, the inner lid consists of metal, or it may be made of relatively rigid plastics. Various composite materials may advantageously be used. Also, it may be an advantage to combine the lid of several layers of different materials, where one of the layers may be of metal. The use of layers of different materials may result in low friction with the lid, which may thus be rotated without the inner lid being rotated simultaneously, and optionally a good adhesion between the inner lid and the upper edge of the container may be established in order to achieve an optimum sealing.

The invention ensures that sealing against ingress of e.g. oxygen or other gases takes place below the inner lid along the upper edge of the container. Hereby, a relatively long sealing face is involved. It may be expedient e.g. to use polypropylene mixed with e.g. polymer. Also polyethylene may be used. These plastics materials have particularly good barrier properties against water vapour. An alternative material may be bandex which has good barrier properties against oxygen and gas.

Preferred materials may be thermoplastics. Particularly polyolefins will be suitable. As an alternative, polypropylene may be used. If the lid is to be subjected to high temperatures, polyester may advantageously be used.

As an alternative material, polyethylene (PE) may be used, and here both homopolymer and random copolymer may be used. Further, plastics materials, such as EVA, EMA and EBA, may be used to advantage.

The lower layer of the inner lid may consist of a soft plastics material which can absorb +/−0.4 mm irregularities of a container edge.

The inner lid may be cut from a 3-layered sheet with a rigid lid at the top, e.g. PP/low friction. A gas barrier may be provided in the centre, made of metal, EVOH, Dow BLox® or Barex®. The lower layer must provide sealing against the container, and the layer must simultaneously absorb glass irregularities. Possible materials may be thermoplastic elastomer, rubber, VLDPE, ULDPE.

As a possible alternative, the lower layer may consist of an applied sealing ring, which may be applied as a hot melt.

The invention claimed is:

1. A lid assembly for closing an opening in a neck of a container, said lid assembly comprising an outer lid member and a planar, multilayered inner lid member, said outer lid member consisting of a top part and a cylindrical collar, said cylindrical collar defining inwardly-extending threads and a single inwardly-extending protrusion which is located below the inner lid member at a level of an upper edge of the neck of the container when the lid assembly is attached to the container, wherein the diameter of the inner lid is larger than an external diameter of the container neck, but simultaneously smaller than an internal diameter of the outer lid, said protrusion of the collar extending radially inwardly to an outer surface of the container neck, and wherein the inner lid has a hole for pressure equalization between the inside of the container and an area between the outer lid and the inner lid, and said planar, multilayered inner lid member consisting of a first layer for sealing against the upper edge of the container and made of a soft thermoplastic elastomer, a second layer having gas barrier properties, and a third layer consisting of thermoplastics which covers the second layer, said third layer making contact with the outer lid, wherein said third layer has a first relatively low friction coefficient with said outer lid and said first layer has a second relatively higher friction coefficient with the upper edge of the neck of the container, wherein during removal of the lid assembly from a container, the outer lid member is rotated relative to the neck of the container and said protrusion will exert an upward pressure against an edge of the inner lid member to cause the inner lid member to be pointwise separated from the upper edge of the neck as the outer lid member is rotated.

2. A lid assembly according to claim 1, wherein the second layer consists of aluminum.

3. A lid assembly according to claim 2, wherein the first layer consists of low density polyolefins.

4. A lid assembly according to claim 3, wherein the first layer consists of a low density polyethylenes.

5. A lid assembly according to claim 4, wherein the third layer consists of polyolefins.

6. A lid assembly according to claim 5, wherein the third layer consists of polyethylene.

7. A lid assembly according to claim 5, wherein the third layer consists of polypropylene.

8. A lid assembly according to claim 5, wherein the third layer consists of ethylene vinyl acetate plastics.

9. A lid assembly according to claim 5, wherein the third layer consists of polyester.

10. A lid assembly according to claim 1, including a seal around the hole in the inner lid sealing against the outer lid, said outer lid having a subarea above the opening of the inner lid which is deflected by a pressure difference.

11. A lid assembly according to claim 1, wherein the centre of the inner lid is secured to the outer lid with a rotatable securing means, wherein a container vacuum through the inner lid pulls the centre of the outer lid downwards, thereby deflecting a subarea of the outer lid.

12. A lid assembly according to claim 11, wherein the collar of the lid has an inwardly directed annular ring as a securing means for the inner lid, said ring extending in an oblique direction relative to the inner lid.

13. A method of opening a lid assembly according to claim 1, by means of twisting it off the neck of the container, wherein during the twisting off of the lid a pointwise upwardly directed pressure is created on the edge of the inner lid, an opening to the volume of the container thus being created and the volume being vented.

* * * * *